US011931788B2

(12) United States Patent
Ogawa et al.

(10) Patent No.: US 11,931,788 B2
(45) Date of Patent: Mar. 19, 2024

(54) METHOD FOR MANUFACTURING PRESSED COMPONENT, AND METHOD FOR MANUFACTURING BLANK MATERIAL

(71) Applicant: JFE Steel Corporation, Tokyo (JP)

(72) Inventors: Takeshi Ogawa, Tokyo (JP); Eiji Iizuka, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 231 days.

(21) Appl. No.: 17/426,260

(22) PCT Filed: Jan. 20, 2020

(86) PCT No.: PCT/JP2020/001724
§ 371 (c)(1),
(2) Date: Jul. 28, 2021

(87) PCT Pub. No.: WO2020/158478
PCT Pub. Date: Aug. 6, 2020

(65) Prior Publication Data

US 2022/0040748 A1 Feb. 10, 2022

(30) Foreign Application Priority Data

Jan. 31, 2019 (JP) ..... 2019-015238

(51) Int. Cl.
*B21D 22/26* (2006.01)
*B21D 19/00* (2006.01)
(Continued)

(52) U.S. Cl.
CPC ..... *B21D 22/26* (2013.01); *B21D 28/00* (2013.01)

(58) Field of Classification Search
CPC ..... B21D 22/00; B21D 22/20; B21D 22/24; B21D 22/26; B21D 28/00; B21D 28/02;
(Continued)

(56) References Cited

U.S. PATENT DOCUMENTS 10,946,427 B2 3/2021 Miyagi et al.
2016/0082495 A1* 3/2016 Miyagi ..... B21D 22/26 72/352

FOREIGN PATENT DOCUMENTS

CN 207103550 U 3/2018
EP 2998043 A1 3/2016
(Continued)

OTHER PUBLICATIONS

English translate (JP6156608B1), retrieved date Dec. 22, 2023.*
(Continued)

*Primary Examiner* — Matthew Katcoff
*Assistant Examiner* — Mohammed S. Alawadi
(74) *Attorney, Agent, or Firm* — Buchanan Ingersoll & Rooney PC

(57) ABSTRACT

Provided is a technology capable of suppressing an edge crack occurring due to stretch flange deformation without being constrained by a target pressed component shape. The technology includes two-stage cutting processing of, when it is estimated that there is concern about risk of occurrence of an edge crack due to stretch flange deformation on an edge of a material (1) to be pressed in press forming, performing twice cutting processing on an edge including at least a site where there is concern about risk of occurrence of the edge crack as pre-processing for press forming in which there is concern about risk of occurrence of the edge crack. In the two-stage cutting processing, cutting to form a partial, beam-shaped overhang portion at a position including a site where there is concern about risk of occurrence of the edge crack is performed in the first cutting and the overhang portion is cut in the second cutting.

15 Claims, 7 Drawing Sheets

(51) Int. Cl.

| | |
|---|---|
| ***B21D 22/20*** | (2006.01) |
| ***B21D 22/24*** | (2006.01) |
| ***B21D 28/00*** | (2006.01) |
| ***B21D 28/02*** | (2006.01) |
| ***B21D 28/26*** | (2006.01) |
| ***B21D 43/28*** | (2006.01) |

(58) Field of Classification Search
CPC ..... B21D 28/10; B21D 28/26; B21D 19/00; B21D 19/08; B21D 19/088; B21D 43/28; Y10T 83/0259
USPC ..... 72/379.2, 362
See application file for complete search history.

(56) References Cited

FOREIGN PATENT DOCUMENTS

| | | | | |
|---|---|---|---|---|
| JP | 0947826 | A | | 2/1997 |
| JP | 2008119736 | A | | 5/2008 |
| JP | 4959605 | B2 | | 6/2012 |
| JP | 5387022 | B2 | | 1/2014 |
| JP | 2014104503 | A | | 6/2014 |
| JP | 6156608 | B | * | 7/2017 |
| WO | 2014185428 | A1 | | 11/2014 |
| WO | 2017038579 | A1 | | 3/2017 |

OTHER PUBLICATIONS

Extended European Search Report for European Application No. 20747762.1, dated Feb. 21, 2022, 10 pages.
International Preliminary Report on Patentability and Written Opinion for International Application No. PCT/JP2020/001724, dated Jul. 27, 2021, 7 pages.
International Search Report and Written Opinion for International Application No. PCT/JP2020/001724, dated Mar. 10, 2020, 6 pages.
Nakagawa et al., "Cut-Off Punching Process—A New Method for Recovery of Stretchability of Sheared Edge", Journal of the Japan Society for Technology of Plasticity, vol. 10. No. 104, (1969), 8 pages. (English Abstract).

* cited by examiner

METHOD FOR MANUFACTURING PRESSED COMPONENT, AND METHOD FOR MANUFACTURING BLANK MATERIAL

CROSS REFERENCE TO RELATED APPLICATIONS

This is the U.S. National Phase application of PCT/JP2020/001724, filed Jan. 20, 2020, which claims priority to Japanese Patent Application No. 2019-015238, filed Jan. 31, 2019, the disclosures of each of these applications being incorporated herein by reference in their entireties for all purposes.

FIELD OF THE INVENTION

The present invention is a technology relating to manufacturing of a pressed component having a component shape on which stretch flange deformation occurs in press forming.

BACKGROUND OF THE INVENTION

In manufacturing a pressed component having a shape including a stretch flange portion manufactured in a manner of press forming, preventing an edge crack due to stretch flange deformation from occurring is one of important problems to be solved. Thus, various types of measures against an edge crack on a stretch flange portion have conventionally been proposed (Patent Documents 1 to 3).

For example, in Patent Document 1, a method for providing excess thickness by using a press die is proposed. However, the method of Patent Document 1 has a limited effect.

In Patent Document 2, using a blank shape that prevents a stretch flange crack from occurring is proposed. However, in the method of Patent Document 2, since the blank shape is constrained, the degree of freedom of the shape of a product is constrained.

Patent Document 3 discloses a method for improving the condition of an edge face of a crack occurrence portion. The method is aimed at improving stretch flange formability of a punched edge face generated by punching of a metal sheet and thus it cannot be applied to a stretch flange portion of the outer periphery of a product. A cut-off punching method using double punching described in Non-Patent Document 1 is also a technology for punching and cannot be applied to a stretch flange portion of the outer periphery of a product.

PATENT DOCUMENT

Patent Document 1: JP 2008-119736 A
Patent Document 2: JP 4959605 B
Patent Document 3: JP 5387022 B

NON-PATENT DOCUMENT

Non-Patent Document 1: Journal of the Japan Society for Technology of Plasticity, Vol. 10, No. 104 (1969-9)

SUMMARY OF THE INVENTION

The present invention has been made in view of the problem as described above, and an object of the present invention is to provide a technology capable of suppressing an edge crack occurring due to stretch flange deformation, avoiding a constraint on a target pressed component shape.

In order to solve the problem, in one aspect of the present invention, a method for manufacturing a pressed component through one or two or more press forming steps includes two-stage cutting processing of, if it is predicted that there is concern about risk of occurrence of an edge crack due to stretch flange deformation on an edge of a material to be pressed in at least one press forming step in the one or two or more press forming steps, performing twice cutting processing on an edge including at least a site where there is concern about risk of occurrence of the edge crack as pre-processing for press forming in which there is concern about risk of occurrence of the edge crack, in which, in the two-stage cutting processing, cutting to form a partial, beam-shaped overhang portion at a position including a site where there is concern about risk of occurrence of the edge crack is performed in first cutting and the overhang portion is cut off in second cutting.

In another aspect of the present invention, a method for manufacturing a blank material to be formed into a pressed component through one or two or more press forming steps includes two-stage cutting processing of, if it is predicted that there is concern about risk of occurrence of an edge crack due to stretch flange deformation on an edge of a material to be pressed in at least one press forming step in the one or two or more press forming steps, performing twice cutting processing on an edge including at least a site where there is concern about risk of occurrence of the edge crack as pre-processing for press forming in which there is concern about risk of occurrence of the edge crack, in which, in the two-stage cutting processing, cutting to form a partial, beam-shaped overhang portion at a position including a site where there is concern about risk of occurrence of the edge crack is performed in first cutting and the overhang portion is cut off in second cutting.

The present invention enables an edge crack occurring due to stretch flange deformation to be suppressed, avoiding a constraint on a target pressed component shape.

DETAILED DESCRIPTION OF EMBODIMENTS OF THE INVENTION

An embodiment of the present invention will now be described with reference to the drawings.

A method for manufacturing a pressed component of the present embodiment is a method for manufacturing a pressed component for manufacturing a target pressed component through one or two or more press forming steps. Press forming at each press forming step is performed by, for example, stamping or drawing. The method for manufacturing a pressed component of the present embodiment is a technology when stretch flange deformation in which a sheet stretches and deforms along an end edge thereof occurs in at least one press forming step.

Figure 1A:
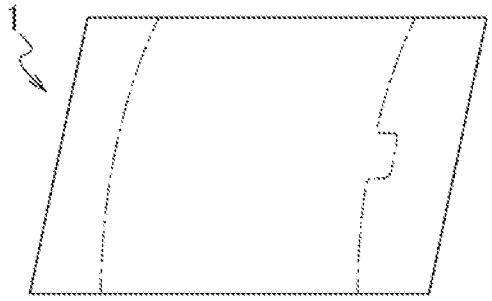
FIG. 1 shows conceptual diagrams illustrating two-stage cutting processing and post press forming according to an embodiment based on the present invention.
Figure 1B:
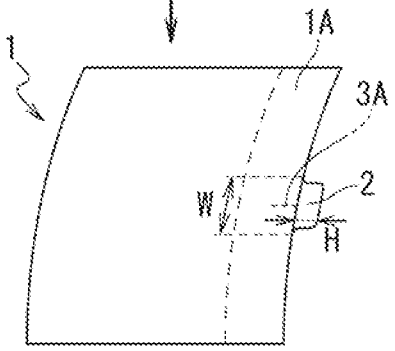
Figure 1C:
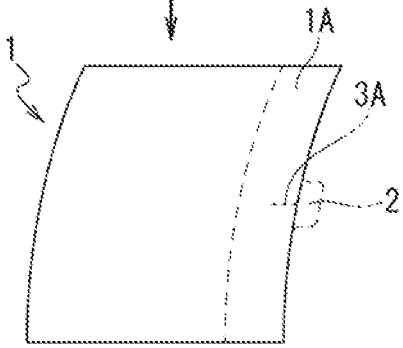
Figure 1D:
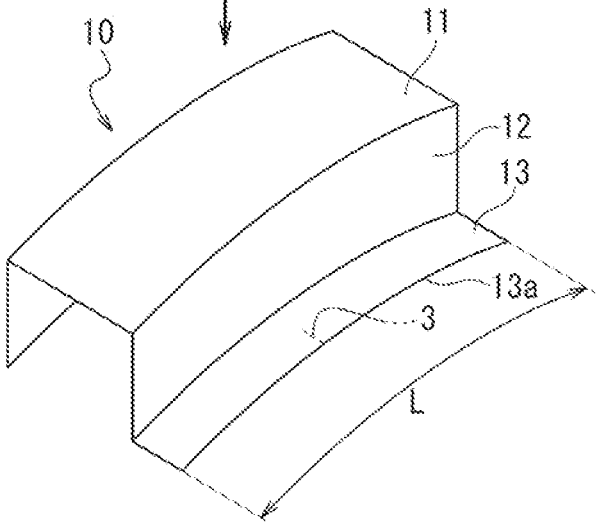

In the present embodiment, in order to simplify description, the description will be made using, as an example, a case where a pressed component 10 having a shape shown in FIG. 1D is manufactured by a single press forming process (a single press step).

A component shape of the pressed component 10 exemplified in FIG. 1D includes a top sheet portion 11, a vertical wall portion 12 continuous with the top sheet portion 11, and a flange portion 13 continuous with the vertical wall portion 12.

Figure 2A:
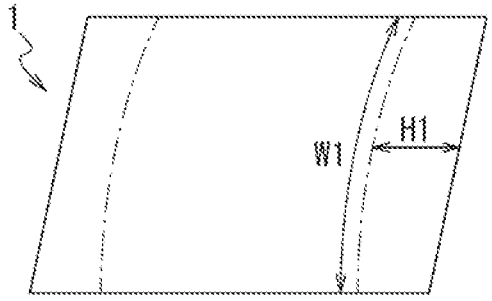
FIG. 2 shows conceptual diagrams illustrating press forming in a case where an embodiment of the present invention is not applied.
Figure 2C:
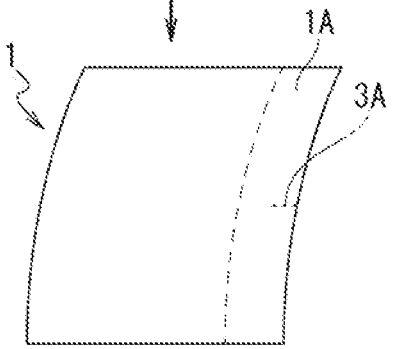
Figure 2D:
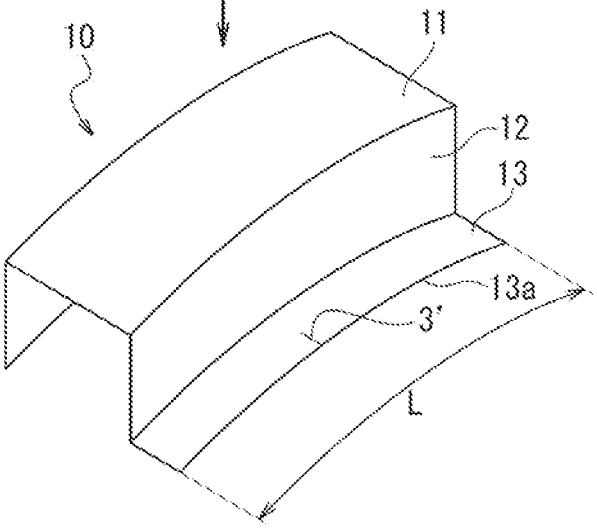
Figure 3A:
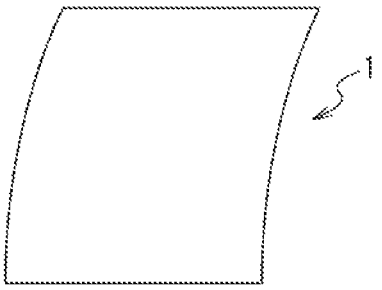
FIG. 3 conceptual diagrams illustrating an example in a case where the two-stage cutting processing based on an embodiment of the present invention is performed during processing steps.
Figure 3D:
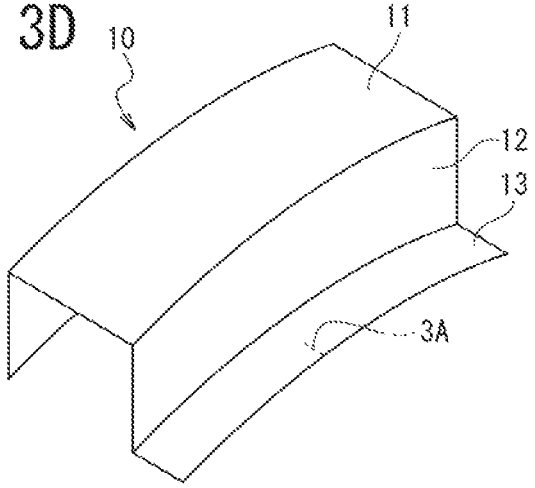
Figure 3B:
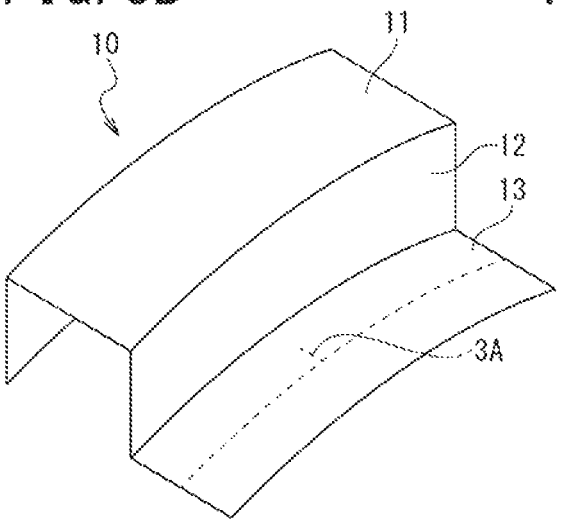
Figure 3E:
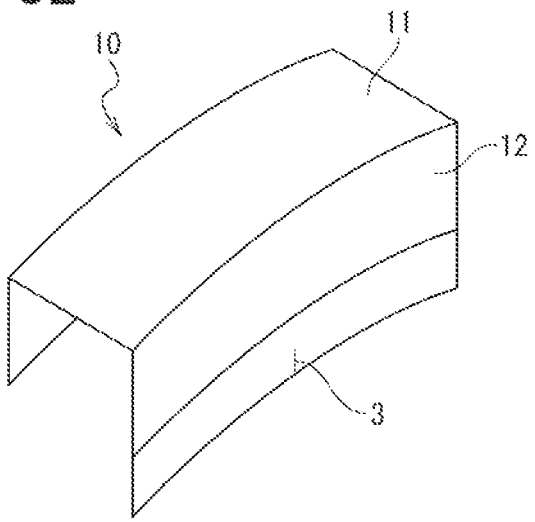
Figure 3C:
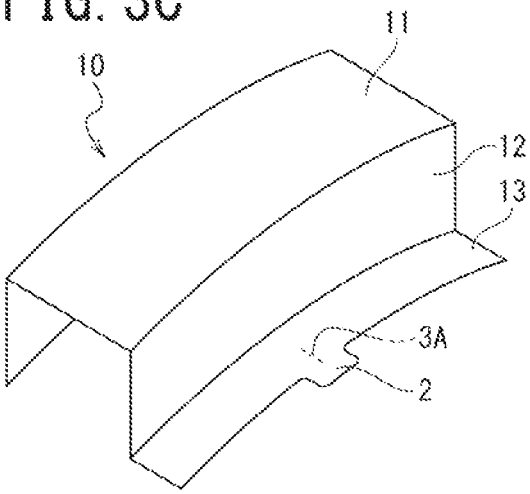

In the present example, it is assumed that the flange portion 13 has a crack risk portion that is a portion of the flange portion 13 where there is concern about risk of occurrence of an edge crack due to stretch flange deformation in a case where press forming to which an embodiment of the present invention is not applied is performed (in a case where the step in FIG. 1B is omitted as shown in FIG. 2). It is noted that, in FIG. 1D, a denotation 3 denotes a position of the crack risk portion, and, in FIG. 2D, a denotation 3' denotes a position corresponding to a crack risk portion where an edge crack actually occurred. Denotations 3A in FIGS. 1B, 1C, and 2C denote positions of crack risk portions 3 on materials to be pressed. A denotation 1A denotes a flange-equivalent portion that is equivalent to a region to be formed into the flange portion 13 on a material 1 to be pressed.

Checking of presence or absence of a crack risk portion 3 due to stretch flange deformation and specifying of a position of the crack risk portion 3 are determined through execution of simulation analysis, such as CAE analysis. The checking of presence or absence of a crack risk portion 3 due to stretch flange deformation and the specifying of a position of the crack risk portion 3 may be performed by actually performing press forming and observing a component after each press forming step.

The manufacturing method includes, as pre-processing for performing press forming, a trimming step in which the outer periphery of a blank material 1, which is an example of the material to be pressed, is sheared into a contour shape matching the component shape of the pressed component 10.

In the present embodiment, an edge of the flange-corresponding portion to the flange portion 13 where there is concern about risk of occurrence of an edge crack due to stretch flange deformation (at least a position of the crack risk portion 3) is subjected to two-stage cutting processing in which two stages of cutting based on an embodiment of the present invention as shown in FIGS. 1B and 1C are performed, in the trimming step.

In the present embodiment, at the time of the first cutting, cutting is performed on an edge of the flange-corresponding portion 1A, which is subjected to the two-stage cutting processing, in the blank material 1, which is a material to be pressed, in such a way that a partial, beam-shaped overhang portion 2 is formed at a position including a site where there is concern about risk of occurrence of the above-described edge crack, as illustrated in FIG. 1B. Subsequently, in the second cutting, the above-described overhang portion 2 is cut off and the blank material 1 is thereby formed into a target contour shape of the end edge, as shown in FIG. 1C.

In other words, in the present embodiment, when the blank material 1 is cut into a target contour shape in the trimming step, a side (end edge) of the flange-equivalent portion 1A is once cut into a shape having the overhang portion 2, which partially overhangs in a cantilever beam shape, at a position including the crack risk portion 3A. Subsequently, in the second cutting, the overhang portion 2 is cut off and thereby the target contour shape is formed. As described above, cutting processing as shown in FIG. 2 (FIG. 2C), which is conventional processing, is performed in two steps shown in FIGS. 1B and 1C in the present embodiment. The steps in FIGS. 1B and 1C may be performed in one step.

It is noted that the two-stage cutting processing based on embodiments of the present invention may be performed independently of the trimming step. For example, a plurality of steps (not shown) may be arranged between the steps shown in FIGS. 1C and 1D, and the two-stage cutting processing based on embodiments of the present invention may be performed during the plurality of steps.

Width W (length along the end edge of the material) of the overhang portion 2 is preferably equal to or less than one third of length L of the flange portion 13 along the end edge thereof or equal to or less than 150 times sheet thickness of the blank material 1.

By forming the temporary, beam-shaped overhang portion 2 having the above-described width W in the first cutting (shearing), compared with a case of not forming the beam-shaped overhang portion 2 temporarily (see FIG. 2), it is possible to more surely suppress strain input to the crack risk portion 3 due to shearing, earning the amount of cutting (cut margin), in the second cutting (shearing) (see an example as will be described later).

It is noted that there is no specific limitation to a lower limit value of the width W of the overhang portion 2, as long as the width W has a width that includes a position at which occurrence of the crack risk portion 3 is predicted and that is permitted to sheared. The lower limit value of the width W is, for example, set at a value equal to or greater than the amount of opening at the end edge formed by an edge crack due to stretch flange deformation. The width W of the overhang portion 2 is preferably equal to or greater than 20 mm, in consideration of easiness of cutting through shearing, and the like.

The amount H of overhang of the overhang portion 2 (a maximum value of the amount of overhang (the amount of projection) from a target contour position) is preferably equal to or less than 10 times the sheet thickness of the blank material 1 or equal to or less than 5.0 mm.

By setting the cantilever-shaped overhang portion 2 as a portion to be cut in the second cutting, it is possible to more surely suppress strain input to the crack risk portion 3 due to shearing, earning the amount of cutting (cut margin), in the second cutting (shearing)

There is no specific limitation to a lower limit value of the amount H of overhang of the overhang portion 2, and any value can be set, as long as the overhang portion 2 overhangs more than 0 mm so as to be permitted to be sheared. The lower limit value of the amount H of overhang is preferably equal to or greater than 1 mm, and more preferably equal to or greater than 3 mm, in consideration of easiness of shearing and the like.

Then, after the above-described two-stage cutting processing, the target pressed component 10 is manufactured.

By performing the above-described two-stage cutting processing as pre-processing for the press forming which may cause concern about risk of occurrence of an edge crack, regular press forming can be used without placing a constraint on a component shape, and further a crack in the crack risk portion 3 due to stretch flange deformation can be prevented.

It is noted that, although, the above description shows an example of a single crack risk portion 3, the present invention can be applied to a case where there are two or more crack risk portions 3. It is required to perform, with respect to each crack risk portion 3, two-stage cutting processing as described above as pre-processing for the press forming in which there is concern about risk of occurrence of an edge crack. In a case where adjacent crack risk portions 3 are close to each other, it may be configured to form one overhang portion 2 including such adjacent crack risk portions 3 in the first cutting.

An advantageous effect of the two-stage cutting processing in which a partial, cantilever-shaped overhang portion that is formed in the first cutting is cut off in the second cutting will be described below.

In general, when shear processing is performed, strain is input in conjunction with slight bending to an end edge of a material to be pressed. Thus, if press forming that causes stretch flange deformation to occur is performed on an edge 13*a* of the flange portion 13 along an end edge of the flange portion 13 as subsequent press forming, probability of occurrence of an edge crack tends to become high.

In contrast, by subjecting a portion where there is concern about a risk of occurrence of an edge crack due to stretch flange deformation to the two-stage cutting processing based on embodiments of the present invention, a stretch flange deformation limit can be improved (see the example). As a result, in the present embodiment, it is possible to prevent occurrence of an edge crack due to stretch flange deformation, avoiding a constraint on a component shape.

Since, in a case where an edge at a position to be formed into a flange is formed in a single shearing operation, as shown in FIG. 2, which shows an example of conventional processing, the edge is cut off at a cutting position indicated by an alternate long and short dash line in FIG. 2A (a cutting position on the right-hand side), cut area of a cut portion that is defined by the width W1 and the amount H1 of overhang from the cutting position is large.

In contrast, in a case where the two-stage cutting processing in which, based on embodiments of the present invention, a partial, beam-shaped overhang portion 2 is formed in the first cutting (cutting at a position illustrated by an alternate long and short dash line in FIG. 1A) and the overhang portion 2 is cut off in the second cutting, as shown in FIG. 1, cut area of a cut portion that is defined by the width W and the amount H of overhang in the second cutting is small (see FIGS. 1B and 1C). In the two-stage cutting processing based on embodiments of the present invention, by forming the partial, cantilever-shaped overhang portion 2 in the first cutting, the cut portion (the overhang portion 2) to be cut off in the second cutting is formed in a substantially small width W and to overhang in a cantilever-shape as shown in FIG. 1B. Thus, it is expected that cutting off the overhang portion 2 in the second cutting causes bending of the steel sheet in the direction of cutting progression to become large and causes strain input at the time of cutting to be mitigated, thereby allowing a large deformation region at the time of cutting to be reduced and the stretch flange deformation limit to be improved.

It is noted that, since a stretch flange crack is more likely to occur on a material having higher tensile strength, the present invention may be suitable for, for example, a high-tensile steel sheet having the tensile strength of 590 MPa or more. Further, a material of the blank material 1 may be applied to not only steel, but also iron alloy, such as stainless, and, furthermore, a non-ferrous material and a nonmetal material. Although a pressed component 10 manufactured in the present embodiment is suitable as, for example, a vehicle component, the present invention can be applied to not only vehicle components, but also all processing that performs press forming on a sheet material.

In the embodiment described above, an example that a target pressed component 10 is manufactured in one-stage press forming has been explained. In general, there is a tendency that, as a shape of a pressed component becomes more complex, the target pressed component is manufactured through two or more press forming steps (a plurality of press forming steps). In a case where a target pressed component is manufactured through a plurality of press forming steps, a press forming step in which a stretch flange crack occurs is not necessarily the final step. In addition, there is a case where stretch flange cracks occur in respective two or more press forming steps.

For example, in a case where a target pressed component is manufactured through five press forming steps, if it is predicted by simulation, such as a CAE, that there is concern about risk of occurrence of a stretch flange crack in the fourth press forming step, it is only required to perform the above-described two-stage cutting processing before the fourth press forming step.

In FIG. 3, an example when a target pressed component (see FIG. 3E) is manufactured in multistage press forming is shown. In an example shown in FIG. 3, FIGS. 3B and 3E show shapes after press forming, respectively, and there exists a crack risk portion 3 on a pressed component to be subjected to press forming into the shape shown in FIG. 3E. In this example, cutting is performed on a flange portion 13 of the pressed component in the first press forming (FIG. 3B) in such a way that, as shown in FIG. 3C, a partial, beam-shaped overhang portion 2 is formed at a position including a site where there is concern about risk of occurrence of an edge crack, and, as illustrated in FIG. 3D, the overhang portion 2 is cut off in the second cutting and thereby a target contour shape of the end edge is formed. Subsequently, the second press forming is performed (see FIG. 3E). This processing can suppress occurrence of an edge crack in the crack risk portion 3.

The two-stage cutting processing of the present invention can also be applied to burring processing, as shown in FIGS. 4 and 5. In an example shown in FIGS. 4 and 5, a portion to be subjected to burring processing is subjected to punching processing by means of two-stage cutting processing before press forming for bulging the portion (FIGS. 4D and 5D) is performed.

Figure 4A:
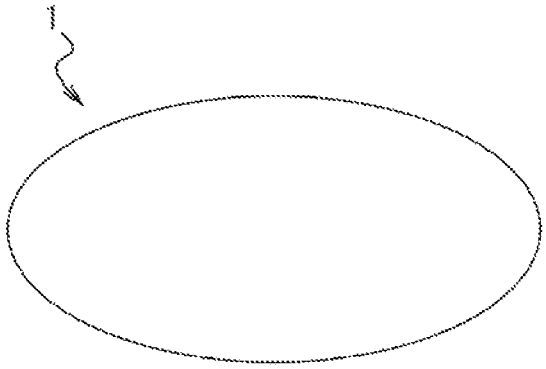
FIG. 4 shows plan views illustrating examples in a case where the two-stage cutting processing based on an embodiment of the present invention is performed on burring processing.
Figure 4B:
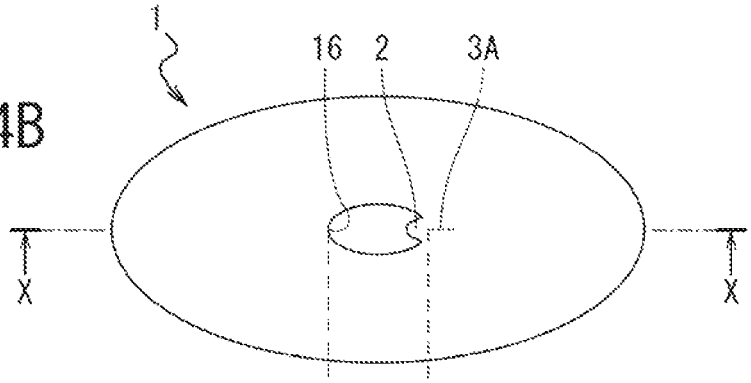
Figure 4C:
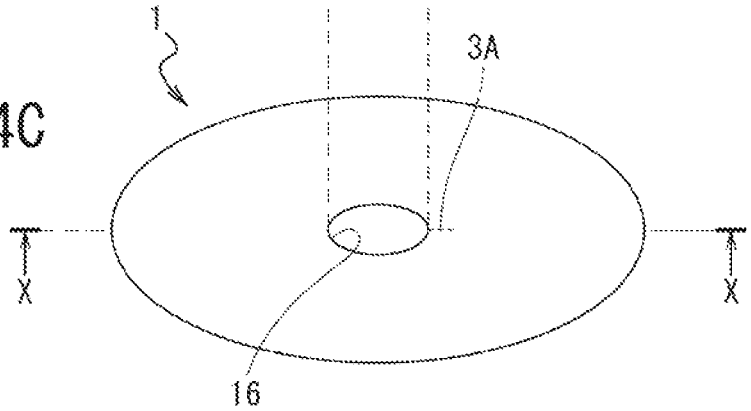
Figure 4D:
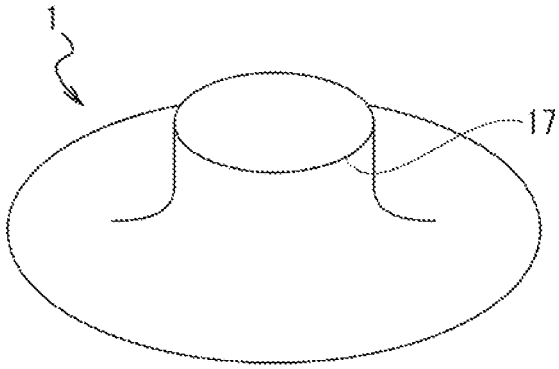
Figure 5A:
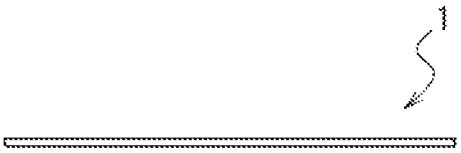
FIG. 5 shows cross-sectional views illustrating examples in a case where the two-stage cutting processing based on an embodiment of the present invention is performed on burring processing.
Figure 5B:
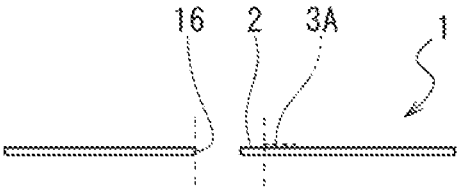
Figure 5C:
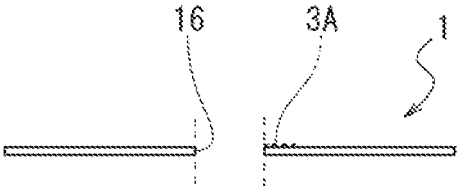
Figure 5D:
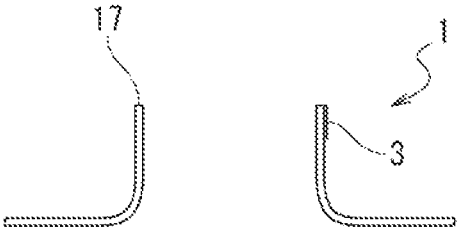

In this case, the first cutting is performed in such a way as to form a beam-shaped overhang portion 2 at a position including a site where there is concern about risk of occurrence of an edge crack within an edge of a hole 16 (FIGS. 4B and 5B). Subsequently, by performing the second cutting, the beam-shaped overhang portion 2 is cut off (FIGS. 4C and 5C).

Then, burring is performed on a portion around the hole 16 (FIGS. 4D and 5D), and the edge of the hole is raised. A denotation 17 denotes a hole position after burring. Generally, a cold-rolled material has anisotropic tendency of being likely to crack in two directions, whereas a hot-rolled material has anisotropic tendencies of being likely to crack in the C-direction. It is only required to form the above-described overhang portion 2 on an edge on which a crack risk portion 3 with regard to the above-described burring exists.

The two-stage cutting processing is not limited to the above-described trimming step before press forming, and, as the two-stage cutting processing, the first cutting and the second cutting may be performed independently of the trimming step. In a case where a plurality of press forming steps are interposed between the first cutting and the second cutting in the two-stage cutting processing, it may be configured such that the two-stage cutting processing is performed before at least one press forming step in the press forming steps is performed.

There is no specific limitation to a cutter used for shearing, and it is only required to use a conventionally known facility. For example, clearance C that is a percentage of a ratio (d/t) of a gap d between the upper blade and the lower blade of a cutter to sheet thickness t of a material to be pressed is preferably equal to or greater than 5.0% and equal to or less than 30.0%.

If the clearance C is smaller than 5.0%, a secondary shear plane occurs at the time of shear processing, which is not preferable as a state of a shear end face. In addition, there is a possibility that tensile residual stress becomes large.

On the other hand, if the clearance C is equal to or greater than 30.0%, a predetermined amount or more of burr occurs on the shear end face, and there is a possibility that the burr impairs formability of the shear end face. Further, since non-uniform deformation stress is provided to a processed surface by the time of the end of shear processing, there is a possibility that tensile residual stress after the end of the shear processing becomes large.

A more preferable clearance C is equal to or greater than 10.0% and less than 20.0%.

Example(s)

Next, an example based on the present invention will be described.

In the following example, a hole expansion test was performed to see advantageous effects of the present invention.

On this occasion, a hole expansion ratio was calculated in each of a case where, based on embodiments of the present invention, two-stage cutting processing in which a partial overhang portion is formed in the first cutting and the overhang portion is cut off in the second cutting was performed (example) and a case where processing in which, without forming a partial overhang portion based on embodiments of the present invention, the entire flange edge is cut off twice was performed (comparative example).

Figure 6A:
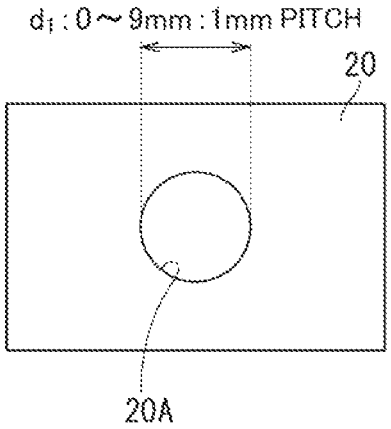
FIG. 6 shows diagrams illustrating pierced holes in a punching test in a comparative example.
Figure 6B:
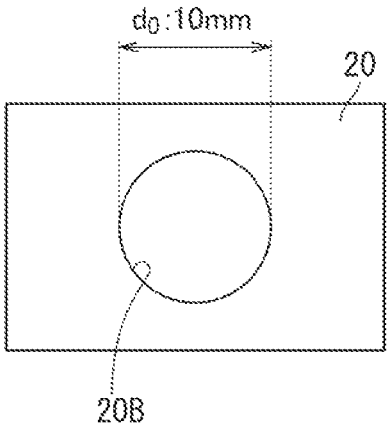

In other words, the comparative example means a case where, as shown in FIG. 6, processing of cutting the entire circumference of a hole twice is performed.

In a test in the comparative example, a sheet material that is made of a material having a tensile strength of 590 MPa and has a thickness of 3.6 mm was used as a specimen 20. The entire circumference of the hole was cut twice as described above in such a way that a pierced hole 20B after the second cutting became a hole having a diameter of 10 mm (target contour shape) (see FIG. 6B). By changing the diameter of a pierced hole 20A formed in the first cutting at a pitch of 0.5 mm within a range of 0 to 9 mm, the amount of cutting (cut margin) in the second cutting was adjusted. For example, if the diameter of the pierced hole 20A formed in the first cutting was 8 mm, the amount of cutting (cut margin) in the second cutting was set at 2 mm. It is noted that a case where the diameter of the first pierced hole 20A is 0 mm corresponds to a case where a hole having a diameter of 10 mm (target contour shape) is formed in a single cutting operation.

Figure 7A:
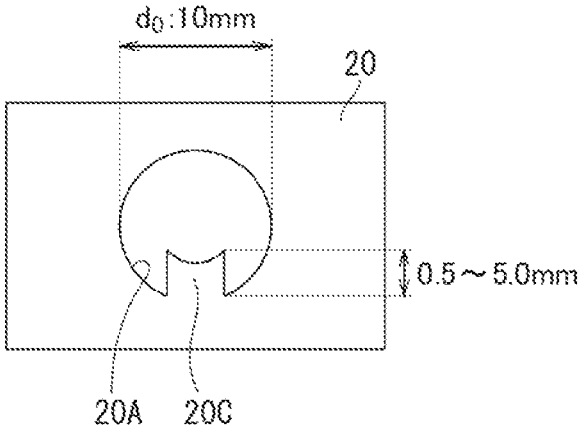
FIG. 7 shows diagrams illustrating pierced holes in a punching test according to the embodiment based on an embodiment of the present invention.
Figure 7B:
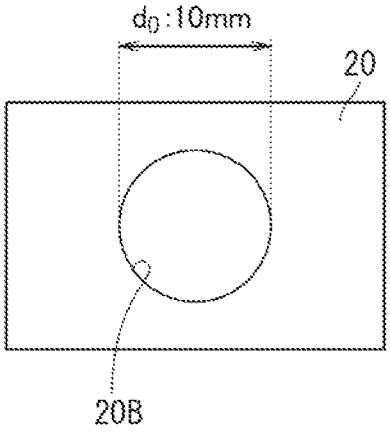

Next, in the example, as shown in FIG. 7, a hole 20B to be formed in the second cutting was set to be a hole having a diameter of 10 mm (target contour shape) in a similar manner to the comparative example (see FIG. 7B). In the example, the diameter of a hole 20A formed in the first cutting was set at 10 mm and, at the same time, an overhang portion 20C as shown in FIG. 7A was formed in the first cutting. In the second cutting, processing of cutting the overhang portion 20C was performed. In the processing, by changing the amount H of overhang of the overhang portion 20C at a pitch of 0.5 mm within a range of 0.5 to 5.0 mm, the amount of cutting (the amount of overhang) in the second cutting was adjusted. The other conditions were set to the same conditions as those in the comparative example.

Figure 8:
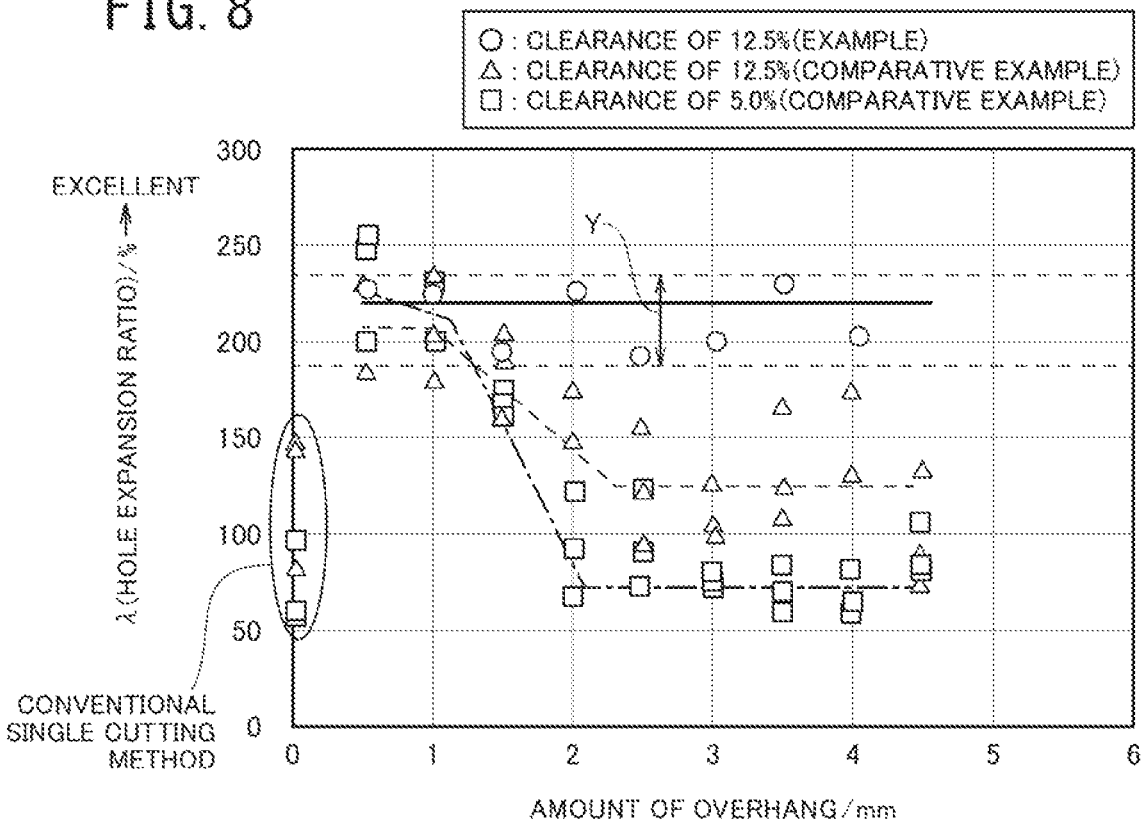
FIG. 8 shows a relationship between the amount of overhang and a hole expansion ratio.

A result of the test is shown in FIG. 8.

In FIG. 8, the amount of cutting (cut margin) in the comparative example is shown as the amount of overhang on the abscissa.

In FIG. 8, circles are a result of the example when the clearance C was set at 12.5%. Triangles and squares are results of the Comparative Example, and denote a result in a case where the clearance C was set at 12.5% and a result in a case where the clearance C was set at 5.0%, respectively. In FIG. 8, plotted marks at positions where the amount of overhang is 0 correspond to cases where a conventional single cutting method was employed.

It was revealed that, in the case of the comparative example in which the entire circumference of a hole is cut off twice as shown in FIG. 6, as the amount of cutting in the second cutting (obtained by subtracting a hole diameter in the first cutting from a hole diameter in the second cutting) increased and the area of a cut portion increased, a hole expansion ratio (X) fell, as shown in FIG. 8.

On the other hand, in the example, approximately the same hole expansion ratios were obtained regardless of the amount H of overhang of the overhang portion 2, as can be seen from FIG. 8. In FIG. 8, the position of an average value of hole expansion ratios in the example is indicated by a horizontal line.

As described above, in a case where two-stage cutting processing like the one in the comparative example (two-stage cutting processing without forming a partial overhang portion) was employed, the hole expansion ratio (X) was improved only at extremely limited values of the amount of cutting (the amount of overhang). As shown in FIG. 8, in a case where the amount of cutting (the amount of overhang) exceeded 2 mm, only similar effects to those when the single cutting method was used were attained.

In contrast, in the case of the two-stage cutting processing based on embodiments of the present invention, it was revealed that, when an opening was formed in the first cutting in such a way that a partial, cantilever-shaped overhang portion 20C was formed and, subsequently, the overhang portion 20C was cut off in the second cutting, the hole expansion ratio (X) was improved over a wide range of the amount of overhang. In other words, in the example, the hole expansion ratio fell within a range indicated by Y in FIG. 8.

Consequently, it is revealed that, in a case where the method for manufacturing a pressed component based on embodiments of the present invention is employed, it is possible to easily suppress an edge crack due to stretch flange deformation.

This application claims priority based on Japanese Patent Application No. 2019-015238, filed on Jan. 31, 2019, the entire disclosure of which is incorporated herein by reference. Hereinbefore, the invention is described with reference to the limited number of embodiments, but the scope of the invention is not limited thereto, and modifications of the respective embodiments based on the above description will be obvious to those skilled in the art.

DENOTATION LIST

1 Blank material (material to be pressed)
1A Flange-equivalent portion
2, 20C Overhang portion
3, 3A Crack risk portion
10 Pressed component
13 Flange portion
H The amount of overhang
W Width

The invention claimed is:

1. A method for manufacturing a pressed component comprising a flange portion through one or two or more press forming steps, where stretch flange deformation occurs in at least one press forming step of the one or two or more press forming steps, the method comprising:

specifying a position of a crack risk portion that is a portion of the flange portion where there is concern about risk of occurrence of an edge crack due to the stretch flange deformation on an edge of a material to be pressed in the at least one press forming step, and performing a two-stage cutting processing on the edge including the crack risk portion before the at least one press forming step, as a pre-processing for press forming where there is the concern about the risk of the occurrence of the edge crack, wherein the two-stage cutting processing includes performing first-cutting to form a cantilever beam portion at a position including the crack risk portion, and performing second-cutting to cut off the cantilever beam portion before the at least one press forming step.

2. The method for manufacturing the pressed component according to claim 1, wherein a width of an overhang portion of the cantilever beam portion is set at a length equal to or less than one third of length of the edge of the flange portion where there is the concern about the risk of the occurrence of the edge crack.

3. The method for manufacturing the pressed component according to claim 2, wherein an amount of overhang of an overhang portion of the cantilever beam portion is set at a value equal to or less than 10 times a sheet thickness of the material to be pressed.

4. The method for manufacturing the pressed component according to claim 2, wherein an amount of overhang of an overhang portion of the cantilever beam portion is set at a value equal to or less than 5.0 mm.

5. The method for manufacturing the pressed component according to claim 2, wherein the press forming is performed by stamping or drawing.

6. The method for manufacturing the pressed component according to claim 1, wherein a width of an overhang portion of the cantilever beam portion is set at a value equal to or less than 150 times a sheet thickness of the material to be pressed.

7. The method for manufacturing the pressed component according to claim 6, wherein an amount of overhang of an overhang portion of the cantilever beam portion is set at a value equal to or less than 10 times a sheet thickness of the material to be pressed.

8. The method for manufacturing the pressed component according to claim 6, wherein an amount of overhang of an overhang portion of the cantilever beam portion is set at a value equal to or less than 5.0 mm.

9. The method for manufacturing the pressed component according to claim 6, wherein the press forming is performed by stamping or drawing.

10. The method for manufacturing the pressed component according to claim 1, wherein an amount of overhang of an overhang portion of the cantilever beam portion is set at a value equal to or less than 10 times a sheet thickness of the material to be pressed.

11. The method for manufacturing the pressed component according to claim 10, wherein the press forming is performed by stamping or drawing.

12. The method for manufacturing the pressed component according to claim 1, wherein an amount of overhang of an overhang portion of the cantilever beam portion is set at a value equal to or less than 5.0 mm.

13. The method for manufacturing the pressed component according to claim 12, wherein the press forming is performed by stamping or drawing.

14. The method for manufacturing the pressed component according to claim 1, wherein the press forming is performed by stamping or drawing.

15. A method for manufacturing a blank material to be formed into a pressed component comprising a flange portion through one or two or more press forming steps, where stretch flange deformation occurs in at least one press forming step of the one or two or more press forming steps, the method comprising:

specifying a position of a crack risk portion that is a portion of a flange corresponding portion to the flange portion where there is concern about risk of occurrence of an edge crack due to stretch flange deformation on an edge of a material to be pressed in the at least one press forming step; and performing a first cutting to form a cantilever beam portion at a position including the crack risk portion and performing a second cutting to cut off the cantilever beam portion before the at least one press forming step.

* * * * *